US011242775B2

(12) United States Patent
Aochi et al.

(10) Patent No.: US 11,242,775 B2
(45) Date of Patent: Feb. 8, 2022

(54) VALVE TIMING ADJUSTMENT DEVICE

(71) Applicant: DENSO CORPORATION, Kariya (JP)

(72) Inventors: Takanobu Aochi, Nisshin (JP); Hitoshi Maegawa, Nisshin (JP); Tomohiro Hayashi, Nisshin (JP); Hiroki Takahashi, Kariya (JP); Kenji Tada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/008,725

(22) Filed: Sep. 1, 2020

(65) Prior Publication Data

US 2021/0087951 A1 Mar. 25, 2021

(30) Foreign Application Priority Data

Sep. 20, 2019 (JP) ..... JP2019-171259

(51) Int. Cl.
*F01L 1/344* (2006.01)
*F01L 1/46* (2006.01)
*F01L 1/047* (2006.01)

(52) U.S. Cl.
CPC ..... *F01L 1/344* (2013.01); *F01L 1/047* (2013.01); *F01L 1/46* (2013.01)

(58) Field of Classification Search
CPC ..... F01L 1/352; F01L 2820/032; F01L 1/047; F01L 1/344; F01L 1/46; F01L 2810/04; F16H 1/32
USPC ..... 123/90.17, 90.15
See application file for complete search history.

(56) References Cited

U.S. PATENT DOCUMENTS 8,468,990 B2 * 6/2013 Yang ..... F01L 1/34403 123/90.17
8,985,075 B2 * 3/2015 Tadokoro ..... F01L 1/34 123/90.17
2007/0051332 A1 * 3/2007 Uehama ..... F01L 1/352 123/90.17
2007/0202981 A1 * 8/2007 Sugiura ..... F16H 1/32 475/162
2012/0174883 A1 * 7/2012 Kokubo ..... F01L 1/352 123/90.15

(Continued)

FOREIGN PATENT DOCUMENTS

JP 2010-159706 7/2010
JP 2012-092721 5/2012

(Continued)

*Primary Examiner* — Patrick Hamo
*Assistant Examiner* — Wesley G Harris
(74) *Attorney, Agent, or Firm* — Nixon & Vanderhye P.C.

(57) ABSTRACT

A valve timing adjustment device includes a drive-side rotating body that rotates in conjunction with a crankshaft, a driven-side rotating body that rotates integrally with a camshaft, a speed reduction mechanism that transmits rotation while allowing relative rotation between the drive-side rotating body and the driven-side rotating body. The driven-side rotating body includes a fastening portion fastened to the end portion of the camshaft by a center bolt, a bearing portion that is located radially outward of the fastening portion and that axially supports the drive-side rotating body, and a fitting outer surface that is fitted to a regulating member on a side where an outer diameter of an axial contact surface with the other member on one side and the other side in the axial direction of the driven-side rotating body is large.

7 Claims, 9 Drawing Sheets

(56) References Cited

U.S. PATENT DOCUMENTS

| | | | | |
|---|---|---|---|---|
| 2015/0275708 | A1* | 10/2015 | David | F01L 1/352 123/90.15 |
| 2016/0327124 | A1 | 11/2016 | McCloy et al. | |
| 2016/0348760 | A1 | 12/2016 | Wigsten | |
| 2017/0138228 | A1 | 5/2017 | Miyachi et al. | |
| 2018/0073598 | A1 | 3/2018 | Pluta et al. | |
| 2018/0073655 | A1 | 3/2018 | Miyachi et al. | |
| 2018/0073656 | A1* | 3/2018 | Miyachi | F01L 1/352 |
| 2019/0277369 | A1 | 9/2019 | Wigsten | |
| 2019/0292952 | A1 | 9/2019 | Miyachi et al. | |
| 2019/0331170 | A1 | 10/2019 | Tsujimoto | |

FOREIGN PATENT DOCUMENTS

| | | |
|---|---|---|
| JP | 2012-189050 | 10/2012 |
| JP | 2016-061234 | 4/2016 |
| JP | 2016-205217 | 12/2016 |

* cited by examiner

VALVE TIMING ADJUSTMENT DEVICE

CROSS REFERENCE TO RELATED APPLICATION

The present application is based on Japanese Patent Application No. 2019-171259 filed on Sep. 20, 2019, disclosure of which is incorporated herein by reference.

TECHNICAL FIELD

The present disclosure relates to a valve timing adjustment device.

BACKGROUND

A valve timing adjustment device is provided in a torque transmission path from a crankshaft of an internal combustion engine to a camshaft thereof and adjusts a valve timing of a valve operating to open/close the camshaft.

SUMMARY

An object of the present disclosure is to provide a valve timing adjustment device in which quietness and durability are improved.

The valve timing adjustment device according to the present disclosure includes a drive-side rotating body that rotates in conjunction with a crankshaft, a driven-side rotating body that rotates integrally with a camshaft, and a speed reduction mechanism that transmits rotation while allowing relative rotation between the drive-side rotating body and the driven-side rotating body. The driven-side rotating body includes a fastening portion fastened to an end of the camshaft by a bolt, and a bearing portion that is located radially outside of the fastening portion and that axially supports the drive-side rotating body.

In the first aspect of the present disclosure, the driven-side rotating body has a fitting outer surface that is fitted to a regulating member on a side where an outer diameter of the axial contact surface with the other member on one side and the other side in the axial direction of the driven-side rotating body is large.

In the second aspect of the present disclosure, a driven-side rotating body has a fitting inner surface that is fitted to a regulating member on a side where the outer diameter of the axial contact surface with the other member on one side and the other side in the axial direction of the driven-side rotating body.

DETAILED DESCRIPTION

Figure 1:
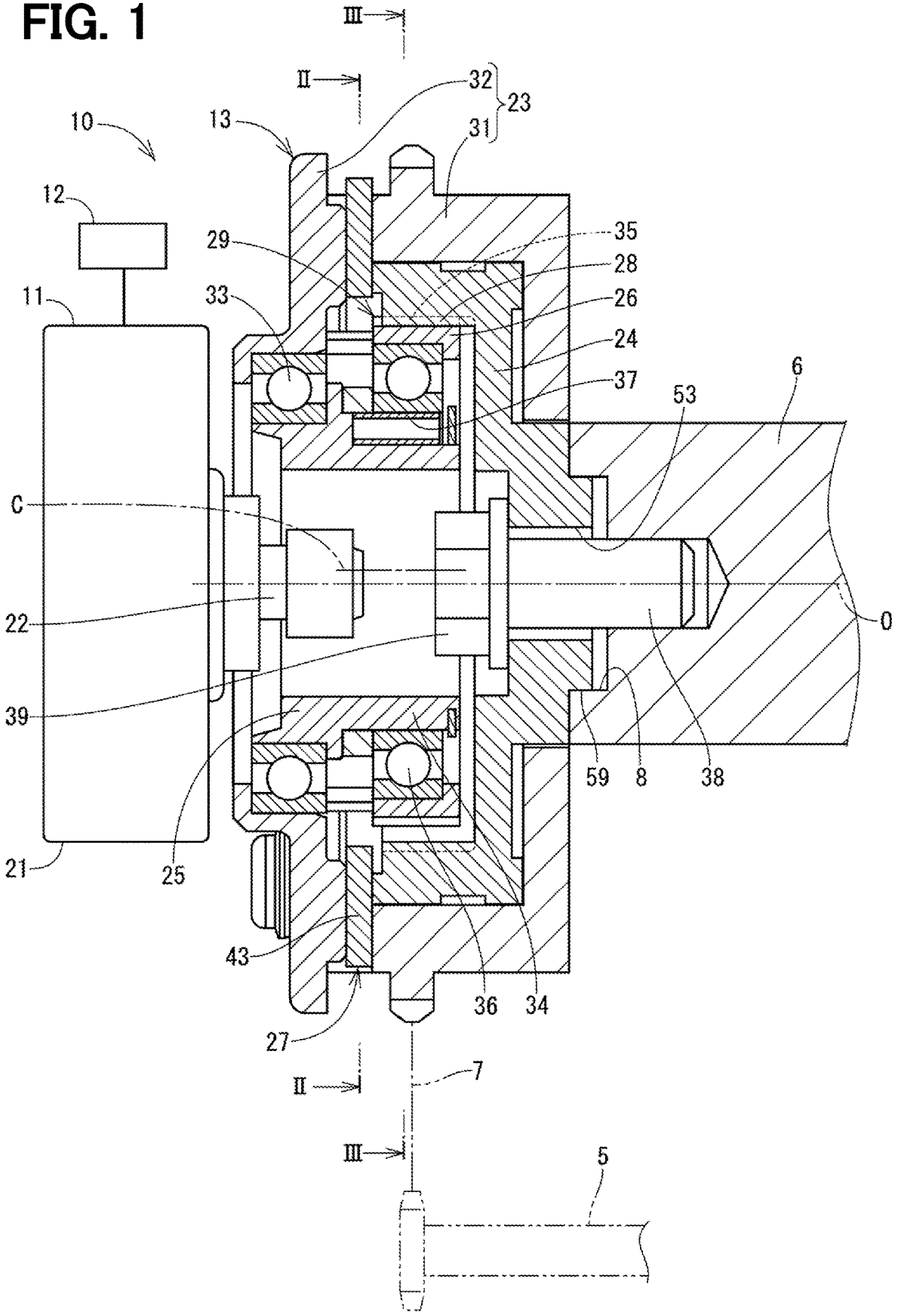
FIG. 1 is a cross-sectional view illustrating a valve timing adjustment device according to a first embodiment.
Figure 2:
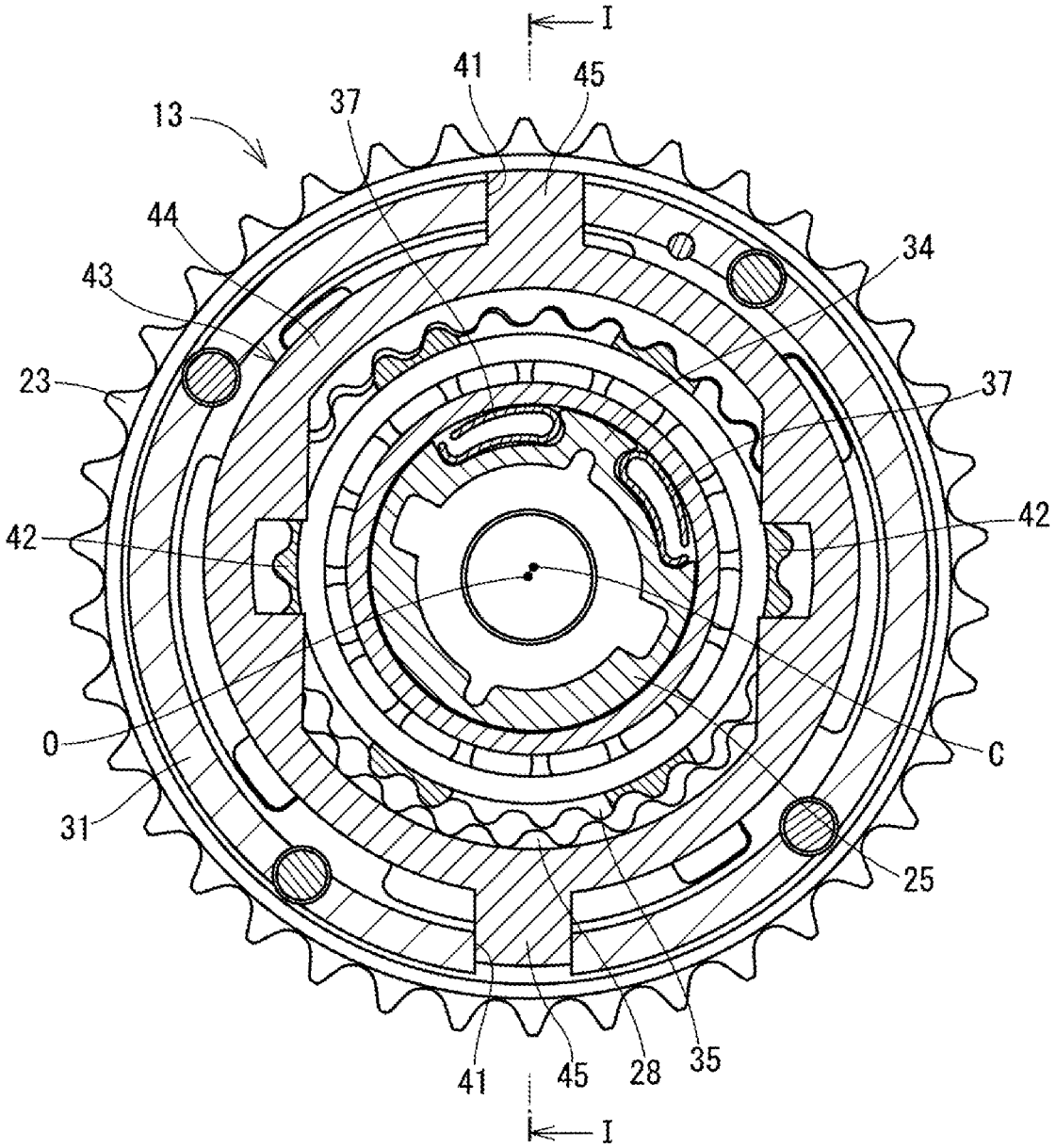
FIG. 2 is a cross-sectional view taken along a line II-II in FIG. 1.
Figure 3:
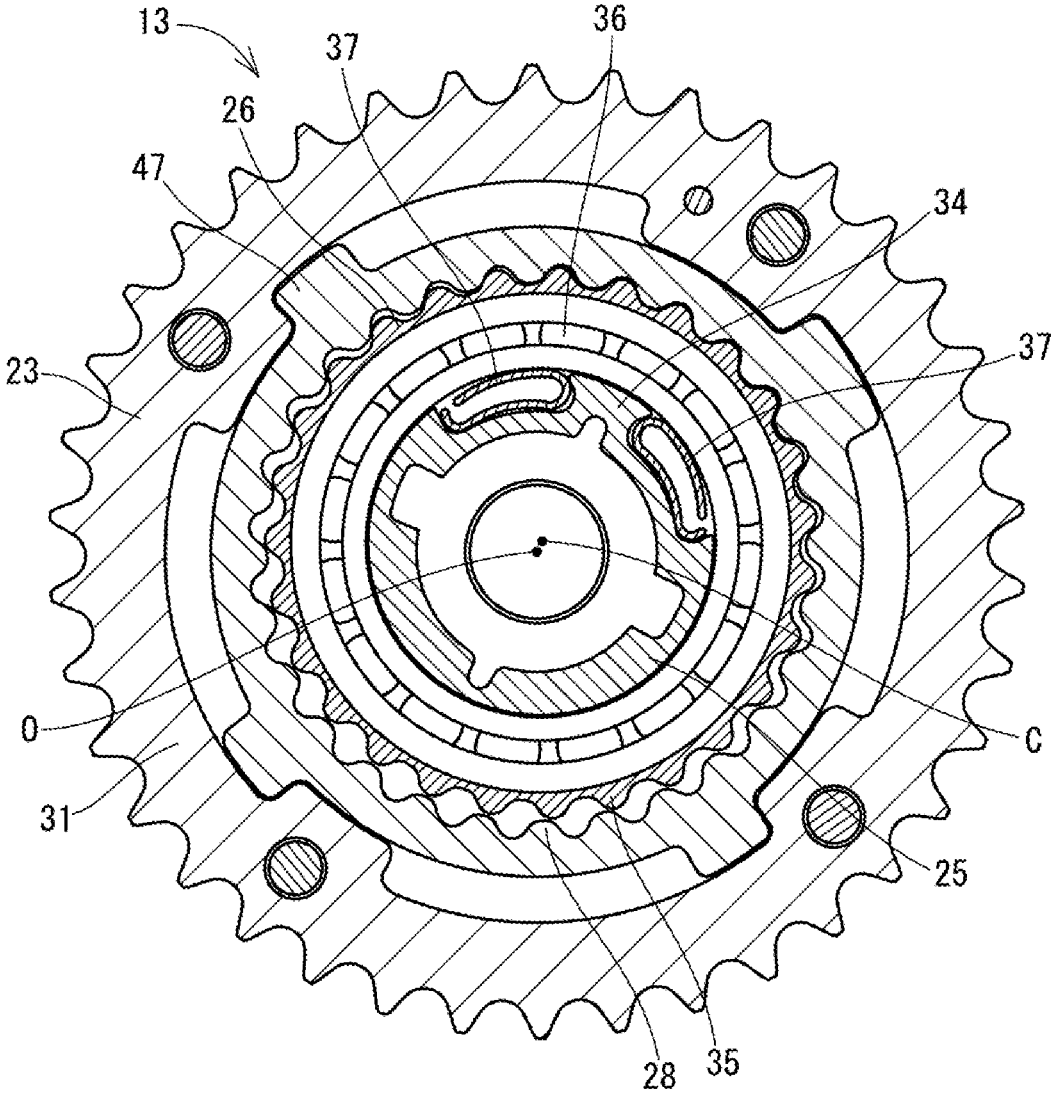
FIG. 3 is a cross-sectional view taken along a line III-III in FIG. 1.

Hereinafter, a plurality of embodiments of a valve timing adjustment device will be described with reference to the drawings. In the embodiments, components which are substantially similar to each other are denoted by the same reference numerals and redundant description thereof is omitted.

First Embodiment

As shown in FIG. 1, the valve timing adjustment device 10 according to the first embodiment is provided in a torque transmission path from a crankshaft 5 to a camshaft 6 in an internal combustion engine of a vehicle. The camshaft 6 opens and closes an intake valve or an exhaust valve (not shown) as a valve. The valve timing adjustment device 10 adjusts a valve timing of the valve.

The valve timing adjustment device 10 includes an actuator 11, a control unit 12, and a phase conversion unit 13.

The actuator 11 is, for example, an electric motor such as a brushless motor, and has a housing 21 and a control shaft 22. The housing 21 rotatably supports the control shaft 22. The control unit 12 is composed of, for example, a drive driver and a microcomputer, and controls the energization of the actuator 11 to rotationally drive the control shaft 22.

As shown in FIGS. 1 to 4, the phase conversion unit 13 includes a drive-side rotating body 23, a driven-side rotating body 24, an eccentric shaft 25, a planetary rotating body 26, and a transmission mechanism 27. The eccentric shaft 25, the planetary rotating body 26, and the transmission mechanism 27 constitute a speed reduction mechanism 29.

The drive-side rotating body 23 is formed by fastening a bottomed tubular sprocket member 31 and a stepped tubular cover member 32, and is arranged coaxially with the camshaft 6. The drive-side rotating body 23 houses the other constituent members 24, 25, 26, and 27. The sprocket member 31 is connected to the crankshaft 5 via a transmission member 7 such as a chain. As a result, the drive-side rotating body 23 rotates around a rotation center line O coaxial with the camshaft 6 in conjunction with the crankshaft 5.

The driven-side rotating body 24 is formed in a cylindrical shape with a bottom, and is arranged coaxially with the camshaft 6. The bottom of the driven-side rotating body 24 is fastened to an end of the camshaft 6 by a center bolt 38. The driven-side rotating body 24 pivotally supports the sprocket member 31 in a radial direction and a thrust direction. As a result, the driven-side rotating body 24 can rotate relative to the drive-side rotating body 23 while rotating around a rotation center line O integrally with the camshaft 6.

An internal gear 28 is integrally formed inside a cylindrical portion of the driven-side rotating body 24. The internal gear 28 is a gear having a tip circle on the radially inner side of a root circle.

An eccentric shaft 25 is formed in a tubular shape, and is arranged coaxially with the camshaft 6. The eccentric shaft 25 is supported by a radial bearing 33 provided inside the cover member 32 so as to be rotatable around the rotation center line O. An eccentric portion 34 that is eccentric with respect to the rotation center line O is formed in a portion of the eccentric shaft 25 that overlaps with the internal gear 28 in the axial direction.

The planetary rotating body 26 has a planetary gear 35 that is eccentric with respect to the rotation center line O and meshes with the internal gear 28. The planetary gear 35 is a gear having a tip circle on the outer side in the radial direction of the root circle. The planetary rotating body 26 is supported by a radial bearing 36 provided outside the eccentric portion 34 so as to be rotatable about a rotation center line C. The planetary gear 35 changes a meshing portion with the internal gear 28 according to the relative rotation of the eccentric shaft 25 with respect to the drive-side rotating body 23, and integrally planetarily moves. At this time, the planetary rotating body 26 revolves around the rotation axis O while rotating around the rotation center line C under the state of meshing with the driven-side rotation body 24 on the eccentric side.

An elastic member 37 is provided between the radial bearing 36 and the eccentric side of the eccentric portion 34. The elastic member 37 biases the planetary rotating body 26 toward the eccentric side in the radial direction via the radial bearing 36. As a result, the planetary gear 35 maintains the meshed state with the internal gear 28.

A transmission mechanism 27 transmits the rotation between the drive-side rotating body 23 and the planetary rotating body 26 while absorbing the eccentricity between them. Specifically, the transmission mechanism 27 is an Oldham mechanism that includes a first engagement groove 41 formed in the sprocket member 31, a second engagement protrusion 42 formed in the planetary rotating body 26, and a slider 43 which oscillates in a radial direction with respect to a first engagement groove 41 and a second engagement protrusion 42 and transmits the rotation between them. The slider 43 includes a ring portion 44, a first engagement protrusion 45 that protrudes radially outward from the ring portion 44 and is fitted into the first engagement groove 41, and a second engagement groove 46 which is formed on the inner side of the ring portion 44 in the radial direction and fitted to the second engagement protrusion 42.

The valve timing adjustment device 10 having the above described configuration adjusts the rotation phase (hereinafter, simply "rotational phase") of the driven-side rotating body 24 with respect to the drive-side rotating body 23 within a predetermined phase adjustment range according to the rotation state of the control shaft 22. As a result, the valve timing adjustment suitable for the operating condition of the internal combustion engine is realized.

Specifically, the control shaft 22 rotates at the same speed as the drive-side rotating body 23, so that the planetary rotating body 26 does not make a planetary motion when the eccentric shaft 25 does not rotate relative to the drive-side rotating body 23. As a result, the rotating bodies 23 and 24 rotate simultaneously with the planetary rotating body 26 and the rotation phase becomes substantially unchanged, so that the valve timing is held and adjusted.

On the other hand, the control shaft 22 rotates at a low speed or in the opposite direction with respect to the drive-side rotating body 23, so that the planetary rotating body 26 makes a planetary motion when the eccentric shaft 25 relatively rotates in a retard direction with respect to the drive-side rotating body 23. As a result, the driven-side rotating body 24 relatively rotates in the retard direction with respect to the drive-side rotating body 23, and the rotational phase changes to the retard side, whereby the valve timing is adjusted to retard.

Further, the control shaft 22 rotates at a higher speed than the drive-side rotating body 23, so that the planetary rotating body 26 makes a planetary motion when the eccentric shaft 25 relatively rotates in an advance direction with respect to the drive-side rotating body 23. As a result, the driven-side rotating body 24 relatively rotates in the advance direction with respect to the drive-side rotating body 23, and the rotational phase changes to the advance side, whereby the valve timing is adjusted to advance.

The phase adjustment range in which the rotation phase is adjusted is defined by the stoppers 47 of the driven-side rotating body 24 being locked by the drive-side rotating body 23 on both sides in the rotation direction.

Next, the fastening structure of the driven-side rotating body 24 will be described.

Figure 7:
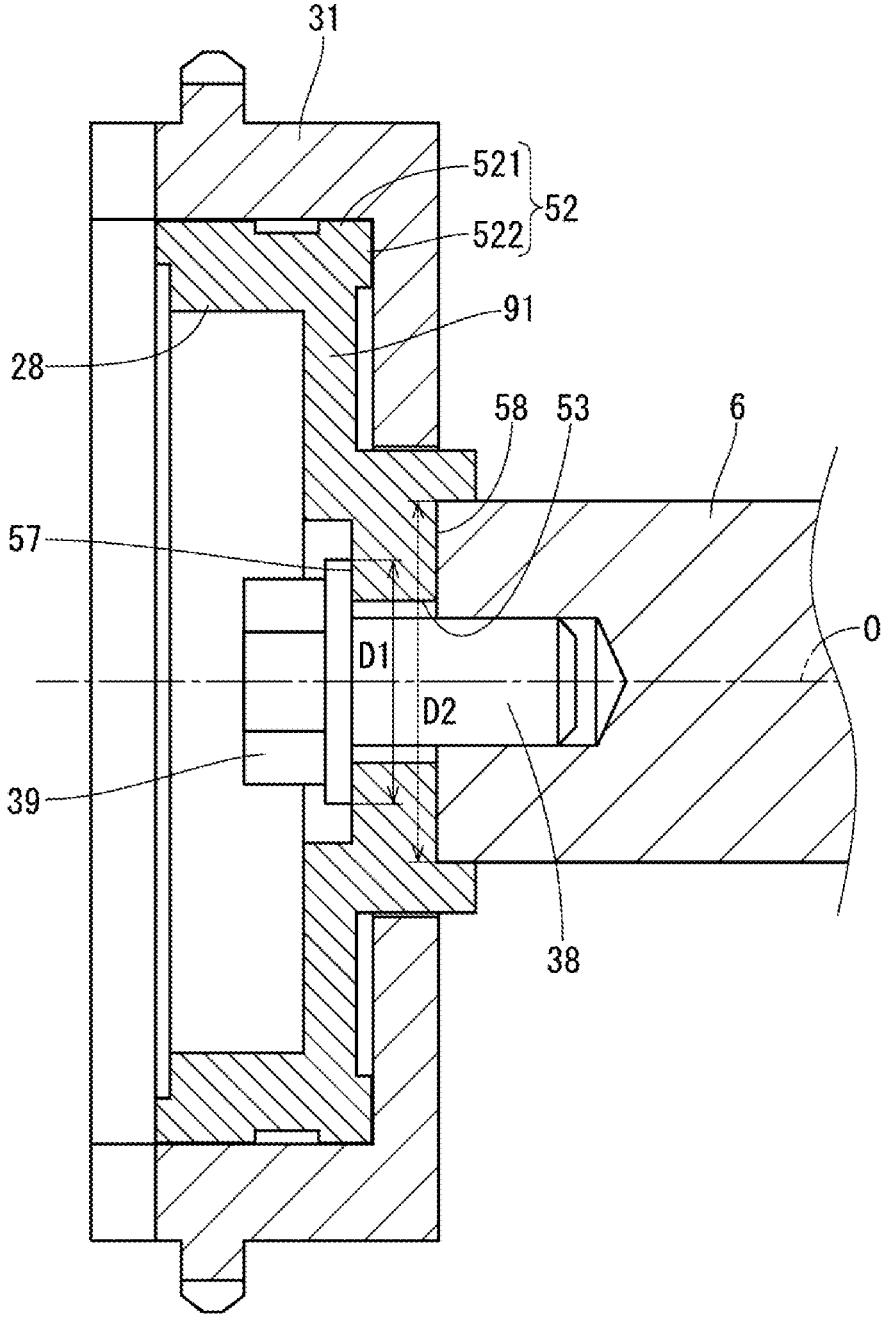
FIG. 7 is a cross-sectional view of a main part of a valve timing adjustment device according to a first comparative embodiment.
Figure 8:
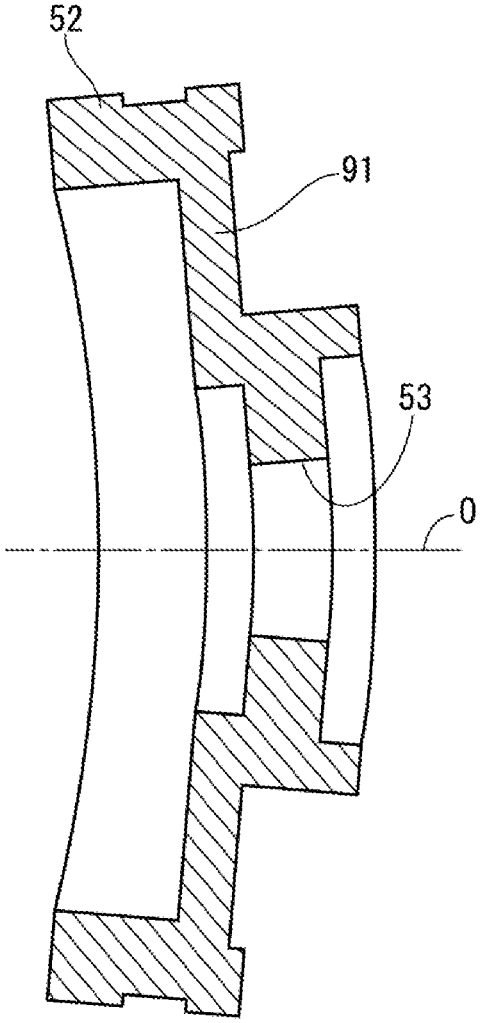
FIG. 8 is a schematic diagram showing how the driven-side rotating body is deformed by bolt fastening in the first comparative embodiment.

In a comparative embodiment shown in FIG. 7, in a bottom portion of the driven-side rotating body 91, an outer diameter D1 of an axial contact surface 57 of the center bolt 38 on the head portion 39 side is smaller than an outer diameter D2 of an axial contact surface 58 on the camshaft 6 side. In such a case, when the center bolt 38 is fastened, as shown in FIG. 8, the bottom portion of the driven-side rotating body 91 becomes convex toward the camshaft side and is deformed so as to warp in the radial direction. The deformation of the driven-side rotating body 91 due to the fastening of the bolts affects the sliding of a shaft supporting portion between the bearing portion 52 of the driven-side rotating body 91 and the drive-side rotating body 23, and there is a problem that quietness and durability are reduced. In the first embodiment, the valve timing adjustment device 10 has a configuration for suppressing the deformation of the driven-side rotating body 24 due to the fastening of the center bolt 38.

Figure 4:
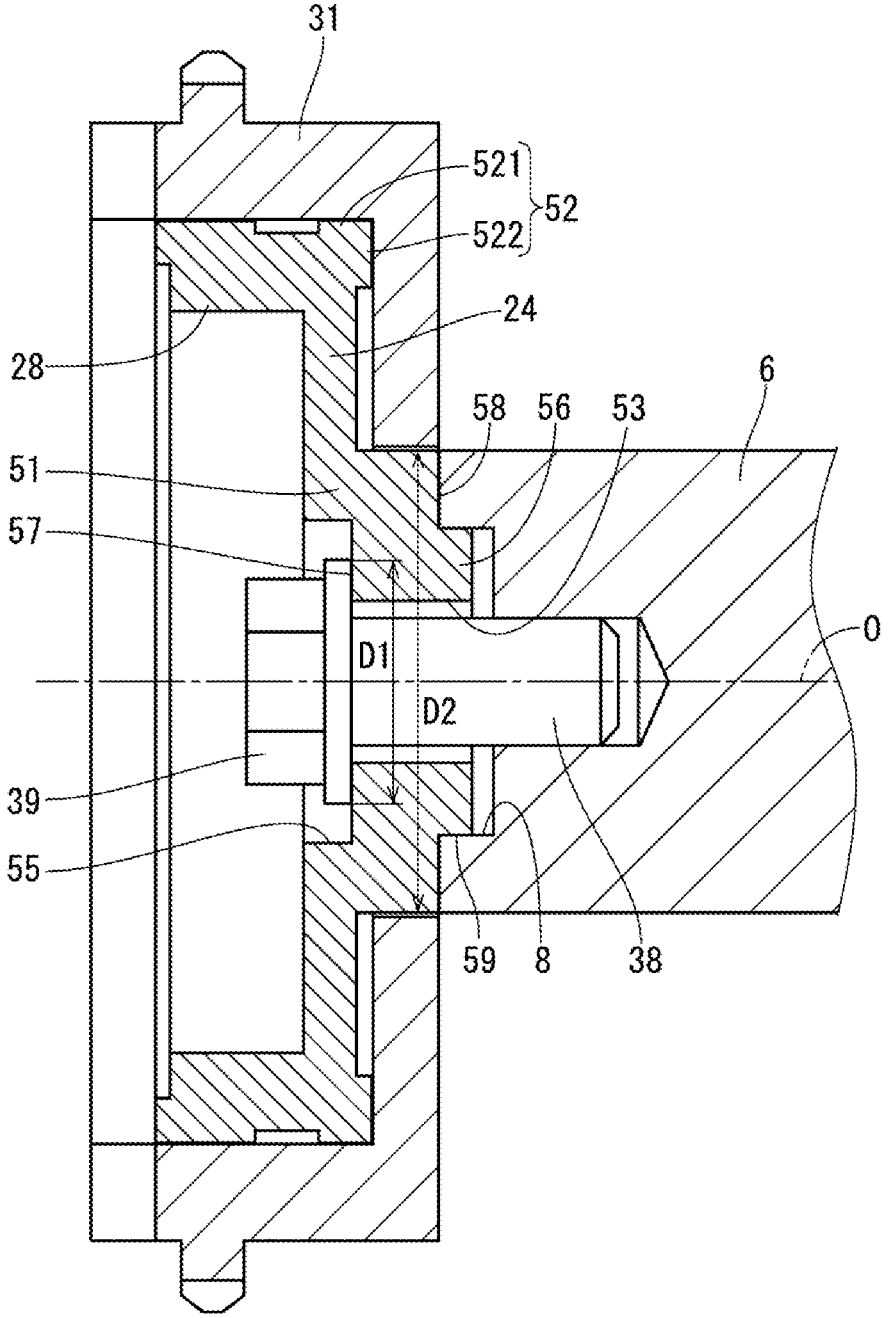
FIG. 4 is a cross-sectional view showing a driven-side rotating body, a drive-side rotating body, a camshaft and a center bolt of FIG. 1.

As shown in FIG. 4, the driven-side rotating body 24 includes a fastening portion 51 fastened to an end of the camshaft 6 by the center bolt 38, and a bearing portion 52 that is located radially outside of the fastening portion 51 and that axially supports the drive-side rotating body 23. The bearing portion 52 has a radial bearing portion 521 located on an outer peripheral portion of the cylindrical portion of the driven-side rotating body 24 and a thrust bearing portion 522 located on an end portion of the cylindrical portion.

The fastening portion 51 includes a bolt insertion hole 53 located on the rotation center line O, a concave portion 55 formed on the head portion 39 side in the axial direction, and a convex portion 56 formed on the camshaft 6 side in the axial direction. On the head portion 39 side of the fastening portion 51, the bottom surface of the concave portion 55 is in contact with the head portion 39 in the axial direction as "another member". Further, on the camshaft 6 side of the fastening portion 51, the radially outer side with respect to the convex portion 56 is in contact with the camshaft 6 in the axial direction as "another member".

The outer diameter D1 of the axial contact surface 57 of the driven-side rotating body 24 on the head portion 39 side is smaller than the outer diameter D2 of the axial contact surface 58 of the driven-side rotating body 24 on the camshaft 6 side. The driven-side rotating body 24 has a fitting outer surface 59 that fits on the camshaft 6 as a "regulating member", and the regulating member is one of the one side and the other side in the axial direction where the outer diameter of the axial contact surface with the other member is large (that is, the camshaft 6 side). In the first embodiment, the fitting outer surface 59 is the outer peripheral surface of the convex portion 56 and is press-fitted into a fitting hole 8 of the camshaft 6.

[Effects]

As described above, in the first embodiment, the driven-side rotating body 24 includes the fastening portion 51 fastened to the end portion of the camshaft 6 by the center bolt 38, the bearing portion 52 that is located radially outward of the fastening portion 51 and that axially supports the drive-side rotating body 23, and the fitting outer surface 59 that is fitted to the regulating member on the side where the outer diameter of the axial contact surface with the other member on the one side and the other side in the axial direction of the driven-side rotating body 24 is large. As a result, the deformation of the driven-side rotating body 24 due to the bolt fastening is suppressed by the contact between the fitting outer surface 59 and the regulating member. Therefore, the sliding state between the bearing portion 52 of the driven-side rotating body 24 and the drive-side rotating body 23 becomes good, and the quietness and durability are improved.

Further, in the first embodiment, the regulating member is the camshaft 6. Accordingly, when the axial contact surface 57, which is the bearing surface of the center bolt 38, is smaller than the axial contact surface 58 on the camshaft 6 side, the deformation of the driven-side rotating body 24 by bolt fastening can be preferably suppressed without separately providing a regulating member.

Second Embodiment

Figure 5:
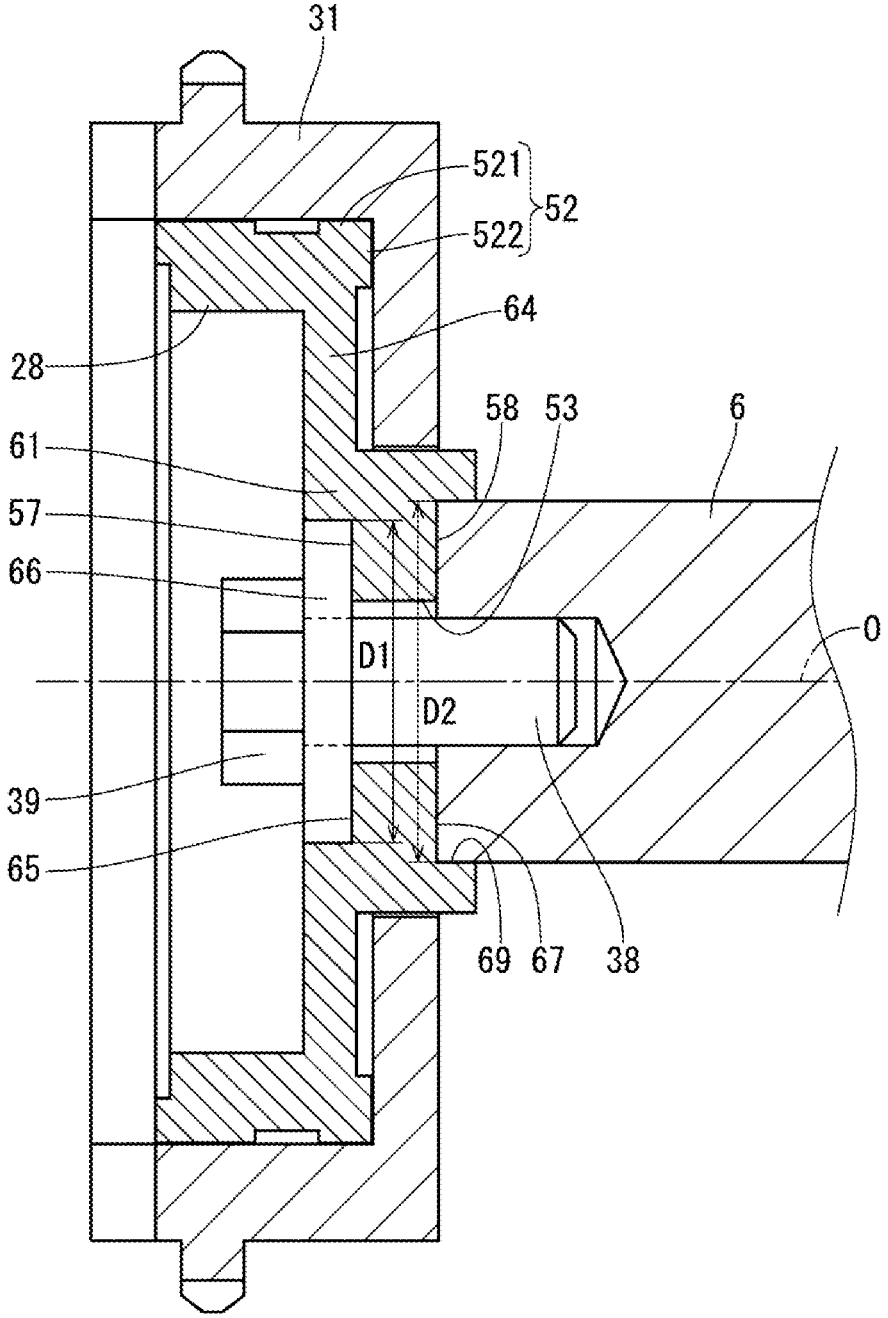
FIG. 5 is a cross-sectional view of the valve timing adjustment device according to a second embodiment and is a view corresponding to FIG. 4 in the first embodiment.

In the second embodiment, as shown in FIG. 5, the fastening portion 61 of the driven-side rotating body 64 has a first concave portion 65 formed on the head portion 39 side in the axial direction and a second concave portion 67 formed on the camshaft 6 side in the axial direction. A hollow columnar member 66 is interposed between the driven-side rotating body 64 and the head portion 39. On the head portion 39 side of the fastening portion 61, the bottom surface of the first concave portion 65 is in contact with the hollow columnar member 66 in the axial direction as "another member". Further, on the camshaft 6 side of the fastening portion 61, the bottom surface of the second concave portion 67 is in contact with the camshaft 6 in the axial direction as "another member".

The outer diameter D1 of the axial contact surface 57 of the driven-side rotating body 64 on the head portion 39 side is smaller than the outer diameter D2 of the axial contact surface 58 of the driven-side rotating body 64 on the camshaft 6 side. The driven-side rotating body 64 has a fitting inner surface 69 that fits on the hollow columnar member 66 as a "regulating member", and the regulating member is one of the one side and the other side in the axial direction where the outer diameter of the axial contact surface with the other member is small (that is, the head portion 39 side). In the second embodiment, the fitting inner surface 69 is the inner peripheral surface of the first concave portion 65 and is press fitted into the hollow columnar member 66.

As described above, the fitting inner surface 69 provided on the side where the outer diameter of the contact surface with another member in the axial direction may be configured to fit the regulating member. Even so, since the deformation of the driven-side rotating body 64 due to the bolt fastening is suppressed by the contact between the fitting inner surface 69 and the regulating member, the same effect as that of the first embodiment can be obtained.

Further, in the second embodiment, the regulating member is the hollow columnar member 66 interposed between the driven-side rotating body 64 and the head portion 39. Accordingly, when the axial contact surface 57 on the head portion 39 side is smaller than the axial contact surface 58 on the camshaft 6 side, it is possible to preferably suppress the deformation of the driven-side rotating body 64 due to the bolt fastening.

Figure 9:
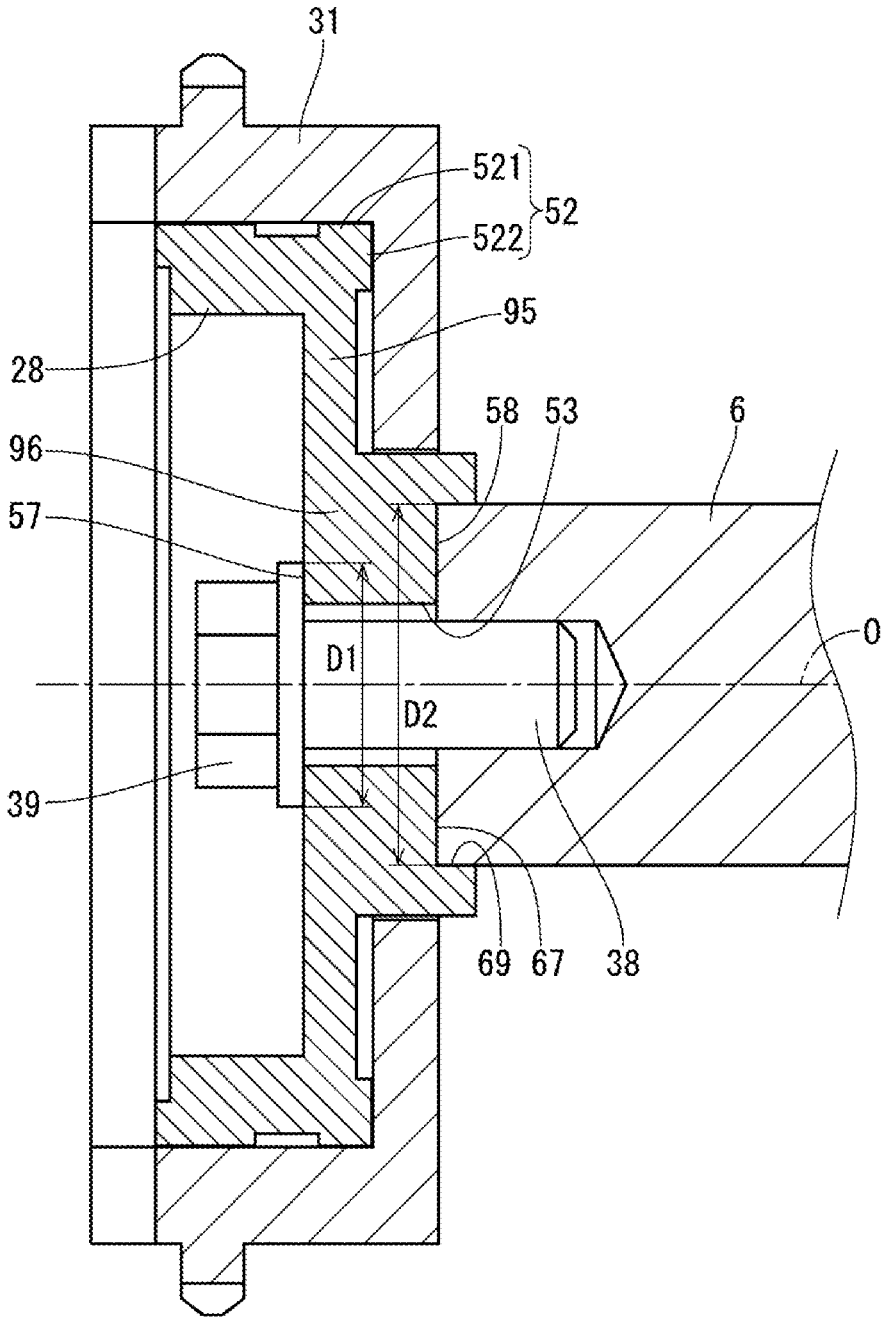
FIG. 9 is a cross-sectional view of a main part of a valve timing adjustment device according to a second comparative embodiment.

Here, when trying to suppress the deformation by forming the fastening portion 96 of the driven-side rotating body 95 to be thick as in the comparative embodiment shown in FIG. 9, the thickness is too different depending on the portions. Therefore, it becomes difficult to produce them by pressing, forging or sintering, and the manufacturing cost increases. On the other hand, in the second embodiment, since the hollow columnar member 66, which is a member different from the driven-side rotating body 64, is used, it is possible to reduce the difference in the wall thickness of the driven-side rotating body 64 depending on the portions. Therefore, the deformation of the driven-side rotating body 64 can be suppressed at low cost.

Third Embodiment

Figure 6:
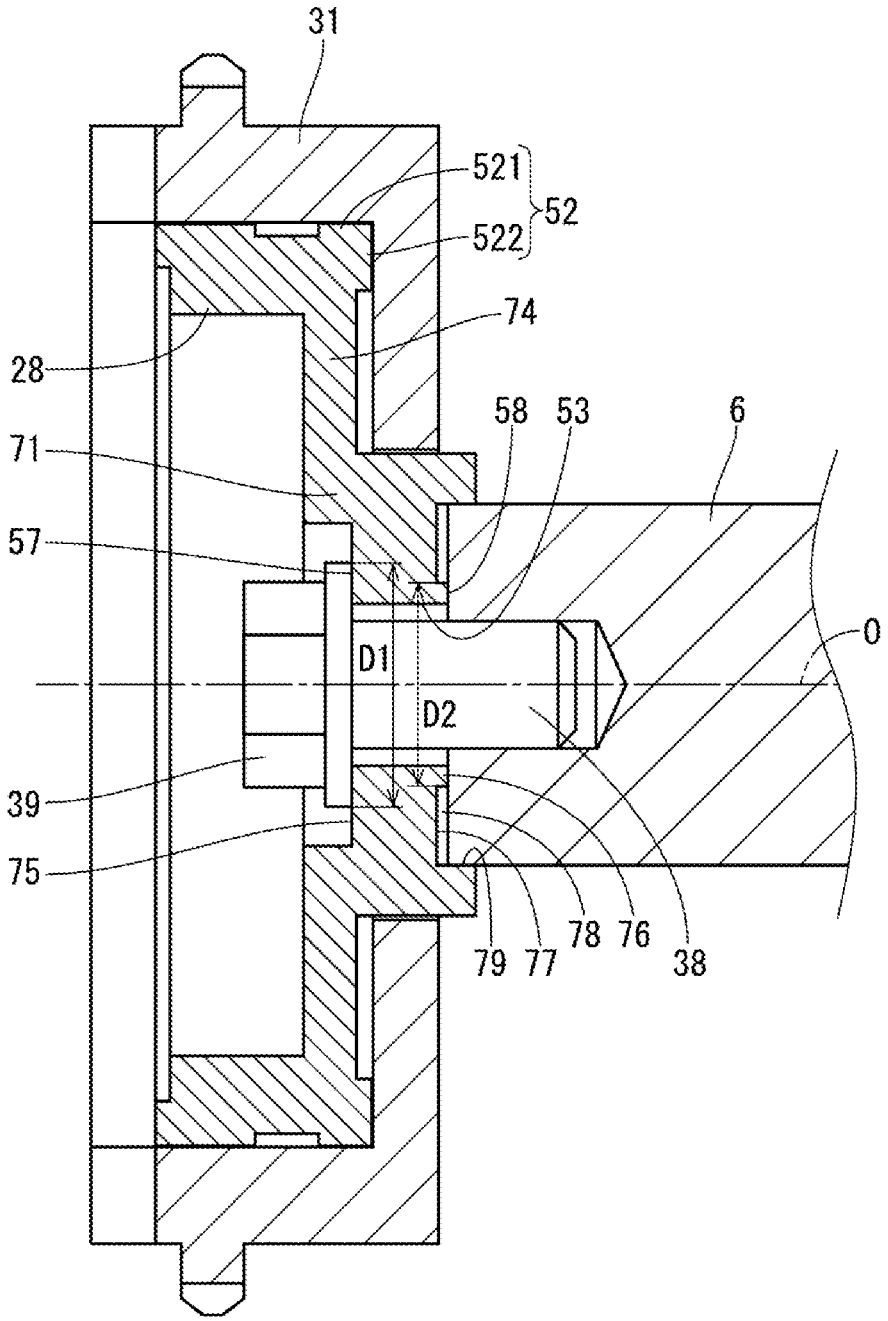
FIG. 6 is a cross-sectional view of a valve timing adjustment device according to a third embodiment and is a view corresponding to FIG. 4 in the first embodiment.

In the third embodiment, as shown in FIG. 6, the fastening portion 71 of the driven-side rotating body 74 has a first concave portion 75 formed on the head portion 39 side in the axial direction, a second concave portion 77 formed on the camshaft 6 side in the axial direction, and a convex portion 76 that projects from the bottom surface of the second concave portion 77 in the axial direction. The convex portion 76 is an annular protrusion. On the head portion 39 side of the fastening portion 71, the bottom surface of the first concave portion 75 is in contact with the head portion 39 in the axial direction as "another member". Further, on the camshaft 6 side of the fastening portion 71, a tip end surface of the convex portion 76 is in contact with the camshaft 6 in the axial direction as "another member". A space 78 in the axial direction is defined between the driven-side rotating body 74 and the camshaft 6 radially outside the convex portion 76.

The outer diameter D2 of the axial contact surface 58 of the driven-side rotating body 74 on the camshaft 6 side is smaller than the outer diameter D1 of the axial contact surface 57 of the driven-side rotating body 74 on the head portion 39 side. The driven-side rotating body 74 has a fitting inner surface 79 that fits on the camshaft 6 as a "regulating member", and the regulating member is one of the one side and the other side in the axial direction where the outer diameter of the axial contact surface with the other member is small (that is, the camshaft 6 side). In the third embodiment, the fitting inner surface 79 is an inner peripheral surface of the second concave portion 77 and is press-fitted into the camshaft 6.

As described above, the fitting inner surface 79 provided on the side where the outer diameter of the contact surface with another member in the axial direction is small may be configured to fit the regulating member. Even so, since the deformation of the driven-side rotating body 74 due to the bolt fastening is suppressed by the contact between the fitting inner surface 79 and the regulating member, the same effect as that of the first embodiment can be obtained.

In addition, in the third embodiment, the driven-side rotating body 74 has the convex portion 76 that projects toward the camshaft 6 side and comes into contact with the camshaft 6 in the axial direction, and the regulating member is the camshaft 6. Accordingly, when the axial contact surface 58 on the camshaft 6 side is smaller than the axial contact surface 57 on the head portion 39 side, it is possible to preferably suppress the deformation of the driven-side rotating body 74 due to the bolt fastening.

Other Embodiments

In another embodiment, the fitting outer surface of the driven-side rotating body is not limited to being press-fitted into the regulation member, but may be fitted into the fitting hole of the regulation member with a clearance fit. In this case, preferably, the clearance between the fitting outer surface and the fitting hole is set to be smaller than the clearance between the radial bearing portion of the driven-side rotating body and the drive-side rotating body. As a result, the clearance between the radial bearing portion and the drive-side rotating body can be secured even if the deformation amount of the driven-side rotating body is maximum.

In other embodiment, the fitting inner surface of the driven-side rotating body is not limited to being press-fitted into the regulation member, but may be fitted into the regulation member with a clearance fit. In this case, preferably, the clearance between the fitting inner surface and the fitting hole is set to be smaller than the clearance between the radial bearing portion of the driven-side rotating body and the drive-side rotating body. As a result, the clearance between the radial bearing portion and the drive-side rotating body can be secured even if the deformation amount of the driven-side rotating body is maximum.

In the second embodiment, the center bolt 38 and the hollow columnar member 66 are separate members. On the other hand, in other embodiment, a part of the head portion of the center bolt may be configured to fit on the fitting inner surface. That is, the center bolt may be the regulating member.

In other embodiment, the transmission mechanism may be a mechanism other than the Oldham mechanism.

The present disclosure is not limited to the embodiments described above, and various modifications are possible within the scope of the present disclosure without departing from the spirit of the disclosure.

A valve timing adjustment device is provided in a torque transmission path from a crankshaft of an internal combustion engine to a camshaft thereof and adjusts a valve timing of a valve operating to open/close the camshaft. The valve timing adjustment device includes a drive-side rotating body that rotates in conjunction with the crankshaft, a driven-side rotating body that rotates integrally with the camshaft, and a speed reduction mechanism provided between the drive-side and the driven-side rotating bodies, and adjusts a rotation phase of the camshaft with respect to the crankshaft based on a rotation state of the speed reduction mechanism. The drive-side rotating body is pivotally supported by the driven-side rotating body in the radial direction and the thrust direction.

The driven-side rotating body and the camshaft are fastened to each other by a bolt arranged on a rotation center line. A deformation of the driven-side rotating body due to the fastening of the bolt affects a sliding of the driven-side rotating body and the drive-side rotating body at a pivotally supported portion, and there is a problem that quietness and durability are reduced.

The present disclosure has been made in view of the above points, and an object of the present disclosure is to provide a valve timing adjustment device in which quietness and durability are improved.

The valve timing adjustment device according to the present disclosure includes a drive-side rotating body that rotates in conjunction with a crankshaft, a driven-side rotating body that rotates integrally with a camshaft, and a speed reduction mechanism that transmits rotation while allowing relative rotation between the drive-side rotating body and the driven-side rotating body. The driven-side rotating body includes a fastening portion fastened to an end of the camshaft by a bolt, and a bearing portion that is located radially outside of the fastening portion and that axially supports the drive-side rotating body.

In the first aspect of the present disclosure, the driven-side rotating body has a fitting outer surface that is fitted to a regulating member on a side where an outer diameter of the axial contact surface with the other member on one side and the other side in the axial direction of the driven-side rotating body is large.

In the second aspect of the present disclosure, a driven-side rotating body has a fitting inner surface that is fitted to a regulating member on a side where the outer diameter of the axial contact surface with the other member on one side and the other side in the axial direction of the driven-side rotating body.

As a result, the deformation of the driven-side rotating body due to the bolt fastening is suppressed by the contact between the fitting outer surface or the fitting inner surface, and the regulating member. Therefore, the sliding state between the bearing portion of the driven-side rotating body and the drive-side rotating body becomes good, and the quietness and durability are improved.

The invention claimed is:

1. A valve timing adjustment device that is provided in a torque transmission path from a crankshaft of an internal combustion engine to a camshaft thereof and adjusts a valve timing of a valve operating to open and close the camshaft, comprising:

a drive-side rotating body configured to rotate in conjunction with the crankshaft;

a driven-side rotating body configured to rotate integrally with the camshaft;

a speed reduction mechanism configured to transmit rotation while allowing relative rotation between the drive-side rotating body and the driven-side rotating body; wherein the driven-side rotating body includes a fastening portion fastened to an end portion of the camshaft by a bolt, a bearing portion that is located radially outward of the fastening portion and that axially supports the drive-side rotating body, a fitting outer surface that directly contacts and is fitted to a regulating member on a camshaft side of the driven-side rotating body, where an outer diameter of an axial contact surface that directly contacts and is fitted to the regulating member on the camshaft side of the driven-side rotating body is larger than an outer diameter of an axial contact surface on another axial side of the driven-side rotating body which is opposite to the camshaft side in an axial direction of the driven-side rotating body, and a diameter of the fitting outer surface is larger than the outer diameter of the axial contact surface on the another axial side of the driven-side rotating body.

2. The valve timing adjustment device according to claim 1, wherein the regulating member includes the camshaft.

3. The valve timing adjustment device according to claim 1, wherein the fitting outer surface is an outer peripheral surface of a convex portion of the driven-side rotating body.

4. The valve timing adjustment device according to claim 1, wherein a head portion of the bolt directly contacts the axial contact surface on the another axial side of the driven-side rotating body.

5. A valve timing adjustment device that is provided in a torque transmission path from a crankshaft of an internal combustion engine to a camshaft thereof and adjusts a valve timing of a valve operating to open and close the camshaft, comprising:

a drive-side rotating body configured to rotate in conjunction with the crankshaft;

a driven-side rotating body configured to rotate integrally with the camshaft;

a speed reduction mechanism configured to transmit rotation while allowing relative rotation between the drive-side rotating body and the driven-side rotating body; wherein the driven-side rotating body includes a fastening portion fastened to an end portion of the camshaft by a bolt having a head portion, a bearing portion that is located radially outward of the fastening portion and that axially supports the drive-side rotating body, a camshaft side and a head portion side, the camshaft side and the head portion side being opposite axial sides of the driven-side rotating body in an axial direction of the driven-side rotating body;

a fitting inner surface that directly contacts and is fitted to a regulating member on the camshaft side of the driven-side rotating body;

a concave portion formed on the camshaft side of the driven-side rotating body in the axial direction; and a convex portion formed as an annular protrusion that protrudes in the axial direction from a bottom surface of the concave portion; and an outer diameter of an axial contact surface on the convex portion on the camshaft side of the driven-side rotating body is smaller than an outer diameter of an axial contact surface on the head portion side of the driven-side rotating body.

6. The valve timing adjustment device according to claim 5, wherein the regulating member includes a hollow columnar member interposed between the driven-side rotating body and a head portion of the bolt.

7. The valve timing adjustment device according to claim 5, wherein the driven-side rotating body has a convex portion that protrudes toward the camshaft and is in contact with the camshaft in the axial direction, and the regulating member includes the camshaft.

* * * * *